United States Patent [19]

Jansen

[11] 4,033,151

[45] July 5, 1977

[54] LIQUID SEPARATION OF SOCK STRING

[75] Inventor: Josephus Johannes Maria Jansen, Schijndel, Netherlands

[73] Assignee: Koninklijke Textielfabrieken, Schijndel (N.B.), Netherlands

[22] Filed: May 19, 1975

[21] Appl. No.: 578,396

[30] Foreign Application Priority Data

May 21, 1974 Netherlands ..... 7406824

[52] U.S. Cl. ..... 66/147; 28/168; 302/11; 83/53

[51] Int. Cl.[2] ..... D04B 35/00

[58] Field of Search ..... 28/76.7, 73, 72 CS; 66/147, 172 R; 302/11, 14, 15, 16; 139/407 CUR; 83/53, 177

[56] References Cited

UNITED STATES PATENTS

| | | | |
|---|---|---|---|
| 1,091,251 | 3/1914 | Stauffer | 302/14 |
| 1,618,395 | 2/1927 | Ward | 302/15 |
| 1,980,782 | 11/1934 | Caller | 302/11 |
| 2,162,415 | 6/1939 | Allen | 302/14 |
| 2,314,618 | 3/1943 | Green | 28/76 T |
| 2,437,735 | 3/1948 | Getaz | 28/76 T |
| 2,476,262 | 7/1949 | McCusker | 28/76 T |
| 2,597,726 | 5/1952 | Hall | 66/147 |
| 2,627,644 | 2/1953 | Foster | 28/73 X |
| 2,653,466 | 9/1953 | McCusker | 28/72 CS |
| 2,729,957 | 1/1956 | Pope, Jr. | 28/76 T X |
| 2,811,029 | 10/1957 | Conner | 28/73 X |
| 3,129,573 | 4/1964 | Sampson et al. | 66/147 |
| 3,129,979 | 4/1964 | Hartshorn | 66/147 |
| 3,157,439 | 11/1964 | Salmona | 66/147 UX |
| 3,314,230 | 4/1967 | Anderson et al. | 302/14 |
| 3,457,739 | 7/1969 | Frand et al. | 28/73 X |
| 3,468,746 | 9/1969 | Scheier | 139/407 |
| 3,499,687 | 3/1970 | Ellis | 302/14 |
| 3,602,013 | 8/1971 | Millar | 66/172 R |
| 3,602,964 | 9/1971 | Currier | 28/76 T |
| 3,686,726 | 8/1972 | Glaze, Jr. et al. | 66/147 X |
| 3,796,066 | 3/1974 | Millar | 28/73 X |
| 3,848,556 | 11/1974 | Terada et al. | 28/76 T |
| 3,859,941 | 1/1975 | Krieger | 28/76 T X |
| 3,880,201 | 4/1975 | Lee, Jr. et al. | 28/72 CS X |
| 3,945,096 | 3/1976 | Miranker | 66/147 X |
| Re. 24,737 | 11/1959 | Bolles et al. | 28/76 T X |

OTHER PUBLICATIONS

Strasser, F., Some Conventional and Unconventional Methods and Processes in Double Jersey Production of the Future, in Tex. Inst. & Ind. 8(12): pp. 337–340, Dec. 1970.

*Primary Examiner*—Louis K. Rimrodt
*Assistant Examiner*—Andrew M. Falik
*Attorney, Agent, or Firm*—Watson, Leavenworth, Kelton & Taggart

[57] ABSTRACT

Method and apparatus for knitting socks by means of a circular knitting machine in which the socks are knitted in a continuous string wherein a few courses are knitted with a soluble yarn between the toe portion of each sock and the welt portion of each subsequent sock, during which the string of socks is drawn rotatingly in downward direction out of the knitting cylinder, with the string of socks being passed from the circular knitting machine directly into a liquid flow wherein the soluble yarn with which the successive socks in the string are interconnected dissolves.

5 Claims, 2 Drawing Figures

LIQUID SEPARATION OF SOCK STRING

Figure 1:
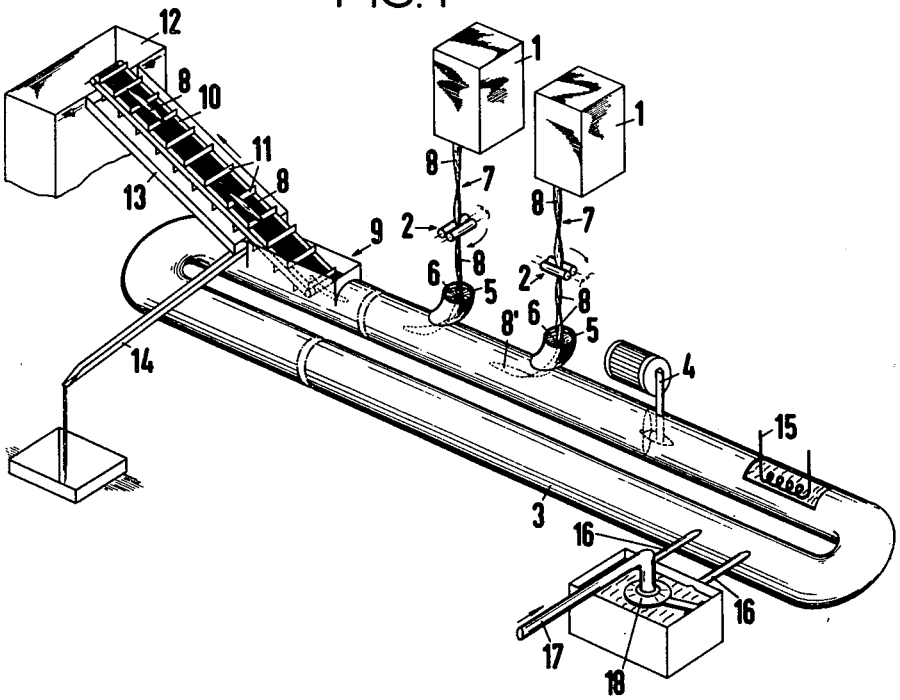

The present invention relates to a method of knitting socks by means of a circular knitting machine, in which the socks are knit in a continuous interconnected string of such socks by knitting a few courses with a soluble yarn between the toe portion of each sock and the welt portion of each subsequent sock, during the knitting operation, the string of socks being drawn rotatingly in a downward direction out of the knitting cylinder.

It is generally known to knit socks in a continuous string on a circular knitting machine. The string of socks which rotates at the same speed as the knitting machine is thereby mechanically drawn out of the knitting machine and guided into a drum which rotates at the same speed as the knitting cylinder. This method has a number of drawbacks.

As it must be rotatable, the collecting drum can have only limited dimensions so that it has to be emptied periodically. In actual practice the collecting drum is filled after about 1 hour, after which for instance 16 socks can then have been knit. The collecting drum is subsequently emptied by cutting the string of socks under the pulling mechanism and subsequently drawing the cut portion from the top of the rotatable drum. The strings of socks removed from the collecting drums of a number of circular knitting machines are collected in containers and moved away, after which the individual socks are separated from the string of socks. Such a method of removal therefore requires much manual work, which influences the price of a pair of socks considerably.

Another drawback of this method is the fouling of the socks which occurs during removal of the string of socks from the rotatable drum. Though usually a gutter is arranged above the collecting drum for catching oil and the like leaking from the knitting machine, it cannot be avoided with such a gutter that the string of socks comes into contact with oil for lubricating the horizontally arranged withdrawal rollers employed for drawing the socks out of the knitting cylinder. Also when removing the string of socks from the collecting drum it is almost impossible to avoid contact of the socks with parts of the knitting machine. Owing to this fouling of the socks high demands are to be made on the washing treatment.

A third drawback of the method described above is that the string of socks can only be removed from the knitting machine when the rotatable drum is stationary. Consequently, the knitting machine has to be stopped for removing a string of socks, which involves additional manipulations, time and risk of yarn breakage and the like. In theory the removal of the strings of socks could be effected during knitting of the heel of a sock, as then the rotatable drum is stationary. In actual practice it appears that this method is rather dangerous for the operator.

It is an object of the invention to avoid these drawbacks.

To this end, according to the invention, the string of socks is passed from the circular knitting machine directly in a liquid flow in which the soluble yarn with which the successive socks in the strings are interconnected dissolves. The last sock (that is to say the first-knit sock) of the string of socks which rotatingly leaves the circular knitting machine during knitting is always in contact with the liquid flow, so that on the one hand the string of socks between the pulling mechanism and the liquid flow is kept slightly tensioned, while on the other hand the full string of socks is free to rotate. As soon as the subsequent sock reaches the liquid flow, the soluble yarn connecting it with the said last sock comes into contact with the liquid and dissolves, as a result of which the last sock is separated from the string and is entrained with the liquid.

According to the invention, for the soluble yarn a type of yarn can be chosen of a material soluble in heated liquid which is a solvent of the material. The liquid flow may then consist of water which is maintained at the desired temperature.

Furthermore the method according to the invention has an additional advantage. The normal procedure in knitting socks in a string comprises passing the strings collected in containers to a washing bath, removing the heat soluble yarn, drying the socks and subsequently sewing them up or linking, after which the socks are put into a dyeing bath. To prevent the open toe edge from fraying during washing, when the soluble yarn disappears, a so-called retraction yarn is included in the last courses of the toe end in addition to the heat-soluble yarn, which retraction yarn shrinks at elevated temperature, for example about 60° C. Without the use of such retraction yarn the washing of socks must be effected in nets in which a number of socks is kept in closely packed condition to prevent fraying. Besides a drying stage, namely between washing and linking, can be saved.

By introducing the strings of socks directly into a liquid flow having a temperature at which the heat-soluble yarn can dissolve and also the heat-shrinking yarn can shrink, the socks always reach the washing and/or dyeing bath with a fixed, so non-fraying open toe edge.

Furthermore, according to the invention, the liquid flow can pass a number of circular knitting machines in order to remove socks from each machine. In another embodiment of the invention the liquid flow can form a closed circuit and pass an apparatus which removes socks present in the liquid flow and puts them into a container.

Moreover, the invention relates to an apparatus for applying the method described above, which apparatus is characterized, according to the invention, by a channel adapted to extend under one or a number of knitting machines and in which channel a liquid can circulate in a closed flow course, the string of socks being introduced into said conduit to effect separation of one from another. The apparatus also includes at least one clearing station where the socks can be removed from the liquid flow. In still another embodiment of the invention the conduit is provided with entrance elbows and collars in said elbows, such collars having entry openings with rounded edges which pass the rotating strings of socks into the conduit with slight play. Thus dirt is excluded from the liquid flow and losses in heat are restricted.

In a further embodiment of the invention the clearing station may have a belt conveyor with a perforated or grid-shaped belt, means being present to discharge the liquid dripping from the socks, while further means are present to maintain a proper liquid level by supplying fresh liquid. In this way there is a continuous change of the liquid flow, which can be limited to a minimum because the liquid dripping from the socks contains a relatively high concentration of dissolved yarn material.

When applying the method and the apparatus according to the invention it is possible to operate a number of circular knitting machines continuously for a long time with minimum inspection, while the socks are collected at a central place. Therefore, the invention constitutes a considerable saving in hand labour.

In connection with the present invention it is observed that it is known to separate socks from a string before the toe portion of each sock is sewn up or linked, by cutting loose a yarn of a specific colour with which one of a few courses are knitted between each pair of socks and removing same. It is also known to knit between each pair of socks some courses of a hot water-soluble yarn, which yarn is also weaker than the yarn with which the sock is knitted and to sever the socks adjacent to these courses after snipping. The remaining yarn portions in the welt portion of each sock can then be removed during a washing treatment in hot water, while the yarn remainders in the toe portion are removed during linking or sewing up.

Figure 2:
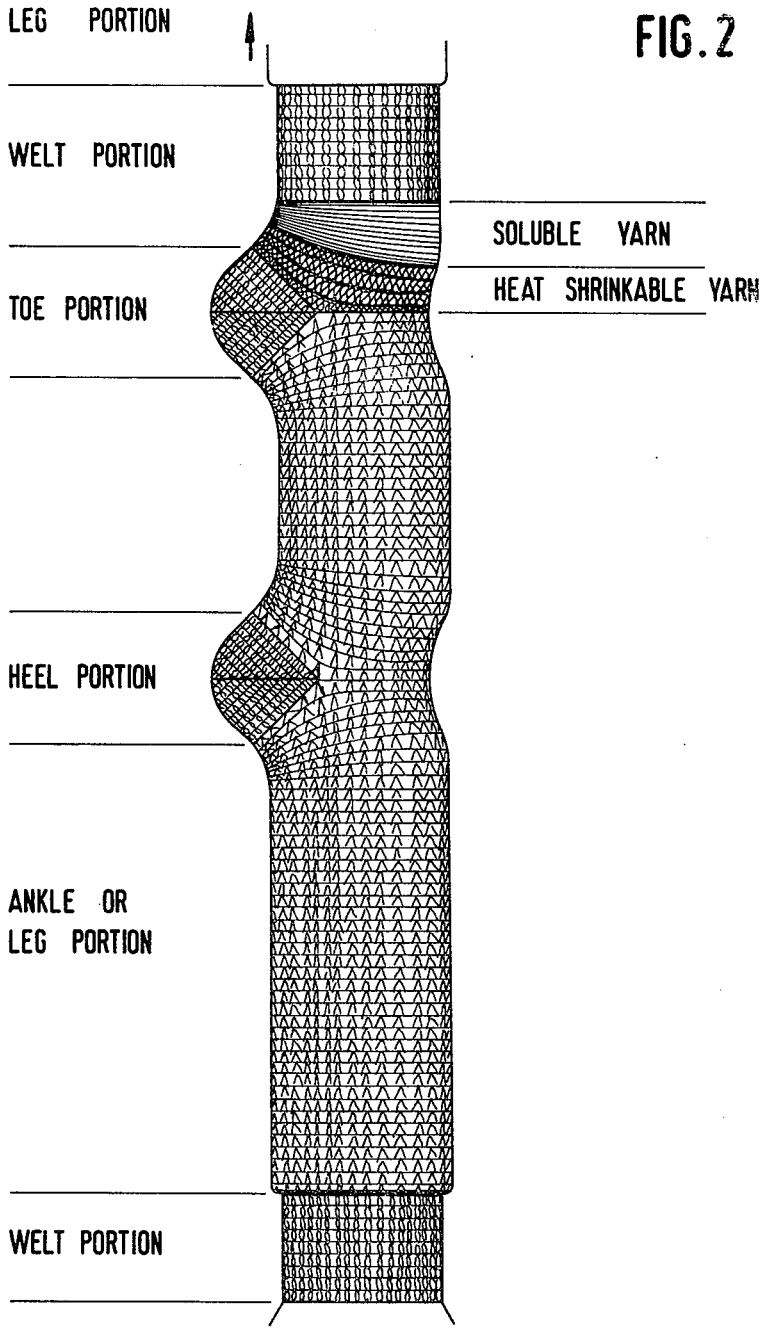

The invention will now be elucidated in more detail with reference to the drawing wherein FIG. 1 is a perspective view of an embodiment of the apparatus for knitting and removing socks and FIG. 2 is an elevational view depicting the manner in which the socks in a string thereof are connected one with another as described, e.g., in pending application Ser. No. 547,457, now U.S. Pat. No. 3,974,525.

FIG. 1 shows a conveyor device for socks disposed under a number of knitting machines which, as they do not form an essential part of the invention are indicated as blocks 1 and are each provided with mechanical withdrawal rollers 2 for drawing a string of socks from the knitting machine, an annular conduit 3 defining a closed flow course in which a liquid is circulated by means of a pump 4. Under each knitting machine 1 conduit 3 is provided with an entrance elbow 5 having an inwardly extending collar 6 which passes a string of socks 7 into the conduit with slight play. Of each string 7 at least one sock 8, namely the last sock 8' (which is therefore the first-knit sock of the string) is in the liquid. Also the end of the sock with which it is connected to a preceding sock of the string is below the liquid level and consequently also the soluble yarn comes into contact with the liquid. The circulating liquid flow exerts a certain tension on the sock 8 hanging therein, so that the respective string 7 is kept a little taut relative to withdrawal rollers 2. As soon as the socks have been immersed in the liquid for a sufficient time the soluble yarn dissolves so that a sock 8 is separated from the string. In the meantime another piece of the string is drawn into the liquid flow so that after a short time the next sock can be severed, etc. The socks are conveyed by the liquid flow through the circulation conduit and arrive at a clearing station 9, where the socks 8 are picked up from the liquid one by one. In the embodiment shown this clearing station is provided with a belt conveyor 10 having a preforated belt with entraining means 11. The lower end of the belt is immersed in the liquid in the annular conduit and at the upper end the socks are droped in a container. When picked up by the conveyor 10 the socks are fully saturated with liquid dripping on the conveyor during the upward transport. To prevent this liquid which, for that matter, contains a relatively high concentration of the dissolved material of the soluble yarn, from falling back in the circulating flow, this liquid is caught in a gutter 13 extending below the belt conveyor 10. This leakage water is discharged through a channel 14. As in this way liquid is continuously withdrawn from the circuit, supplementation with fresh water is necessary. This can be controlled, for example, by a level indicator such as a float 18 which controls liquid make-up discharge from a source thereof through pipes 16 communicating with conduit 3, by controlling liquid supply to the source provided through pipe 17. When using heat-soluble yarn for the courses with which the socks are interconnected in a string (like the commercially available Solvron) it is necessary that the liquid in the circulation circuit be heated to the dissolving temperature. To this end a heating element 15 is schematically shown in the drawing. To prevent over-heating, the heating element can be controlled thermostatically, if desired.

It appears from practice that the concentration of dissolved yarn material in the circulating liquid is maintained at an acceptable level and supersaturation such that yarn material is no longer dissolved therein does not occur. This can be ascribed to the fact that the water dripping from the socks has a high concentration of yarn material compared with the remaining liquid in the circuit, while also pieces of yarn not yet dissolved adhere to the socks. They are removed in the next washing bath. However, if the concentration in the conduit should become too high, an overflow can be arranged and greater quantities of fresh water can be suppled.

I claim:

1. In apparatus for knitting socks comprising a circular knitting machine having a knitting cylinder on which socks can be knitted and courses of a soluble yarn can be knitted between the toe portion of each sock knit and the welt portion of each subsequently knit sock to produce a continuous string of such socks, and means for drawing the string of socks rotatingly downwardly out of the knitting cylinder, the improvement which comprises a conduit defining a closed flow course, a liquid in said conduit, means for circulating said liquid in said conduit, said conduit having entrance means through which said string of socks can be passed to introduce same into said liquid for dissolving said soluble yarn and thereby separating the socks one from another, and means communicating with said conduit for removing socks from said liquid.

2. An apparatus in accordance with claim 1 wherein said conduit entrance means comprises an elbow connected to said conduit and having a collar therein, said collar having an entry opening with rounded edges through which passes the rotating strings of socks.

3. An apparatus in accordance with claim 1 in which said means for removing socks from said liquid includes a belt conveyor having a perforate belt, a lower end of said belt being immersed in said liquid and having sock entraining flights for packing up socks from said liquid and transporting same out of said conduit, means disposed under said belt to collect any liquid passing therethrough and to discharge said collecting liquid at a location remote from said conveyor, and means for maintaining a constant level of liquid in said conduit.

4. An apparatus in accordance with claim 3 in which said means for maintaining a constant level of liquid in said conduit comprises a source of liquid, a pipe connecting said source with said conduit, and a float for controlling flow from said source through said pipe responsive to variations in the liquid level in said conduit.

5. An apparatus in accordance with claim 1 further comprising means for heating the liquid in said conduit to a predetermined temperature.

* * * * *